US006056596A

United States Patent [19]

Etiembre

[11] Patent Number: 6,056,596

[45] Date of Patent: May 2, 2000

[54] CONNECTING COUPLER FOR A PRINTED-CIRCUIT BOARD

[75] Inventor: Dominique Etiembre, Spay, France

[73] Assignee: Framatome Connectors International, Courbevoie, France

[21] Appl. No.: 09/210,158

[22] Filed: Dec. 11, 1998

[30] Foreign Application Priority Data

Dec. 17, 1997 [FR] France ..... 97 16007

[51] Int. Cl.[7] ..... H01R 13/73; H01R 1/01

[52] U.S. Cl. ..... 439/572

[58] Field of Search ..... 439/572, 571, 439/78; 403/230

[56] References Cited

U.S. PATENT DOCUMENTS

| | | | |
|---|---|---|---|
| 4,784,550 | 11/1988 | Wollar | 411/32 |
| 5,108,308 | 4/1992 | Northcraft et al. | 439/555 |
| 5,266,052 | 11/1993 | Phillip | 439/562 |

FOREIGN PATENT DOCUMENTS

| | | | |
|---|---|---|---|
| 0 773 609 A1 | 5/1997 | European Pat. Off. . | |
| 0773609 | 5/1997 | European Pat. Off. | H01R 23/70 |
| 2 185 160 | 7/1987 | United Kingdom . | |
| WO 95/13636 | 5/1995 | WIPO . | |
| WO 96/04695 | 2/1996 | WIPO . | |
| WO 9604695 | 2/1996 | WIPO | H01R 9/09 |

*Primary Examiner*—Neil Abrams
*Assistant Examiner*—Chandrika Prasad
*Attorney, Agent, or Firm*—Perman & Green, LLP

[57] ABSTRACT

The connecting coupler for a printed-circuit board is inserted in two housings (3, 4) made of electrically insulating material of connectors placed one on each side of the printed-circuit board (1) and each bearing a contact member (5, 6), each contact member (5, 6) comprises an internal cavity (7, 8) open to that face of the insulating housing (3, 4) that rests against the printed-circuit board (1). The coupler further comprises a contact piece (9) in the shape of a rod, the opposite ends of which can engage in the respective cavities (7, 8) of the two contact members (5, 6), while the central part (10) of this contact piece (9) is forcibly inserted into a hole (11) in the printed-circuit board (1).

This coupler allows couplings to printed-circuit boards of varying thickness.

7 Claims, 1 Drawing Sheet

CONNECTING COUPLER FOR A PRINTED-CIRCUIT BOARD

The present invention relates to a connecting coupler for a printed-circuit board.

Couplers which allow a high-power electrical connection to be made through a wall are known. The coupler passes right through the printed circuit without making an electrical connection with it.

One of the contacts bears a rod-shaped end intended to be forcibly engaged in a hole in the printed-circuit board and in a cavity wade in the contact that lies on the other side of the printed-circuit board. Such contacts are of the type commonly known as press-fit contacts.

Known couplers of the above type have the drawback of being ill-suited to couplings to printed-circuit boards of varying thickness.

The object of the present invention is, in particular, to overcome the above drawback.

The invention is thus aimed at a connecting coupler for a printed-circuit board inserted in two housings made of electrically insulating material of connectors which are intended to be placed one on each side a the printed-circuit board and each bearing a contact member.

According to the invention, this coupler is characterized in that each contact member comprises an internal cavity open to that face of the insulating base that is intended to rest against the printed-circuit board, and in that the coupler further comprises a contact piece in the shape of a rod, the opposite ends of which can engage in the respective cavities of the two contact members, while the central part of this contact piece is intended to be forcibly inserted into a hole in the printed-circuit board to establish an electrical connection between a conducting track of the printed circuit and the two contact members borne by the two insulating bases.

Thus, upon mounting an the printed-circuit board, the rod-shaped contact piece is forcibly inserted, in turn, into the cavity of the contact member borne by one of the bases, into the, preferably metallized, hole in the printed-circuit board, and into the cavity of the contact member borne by the other base.

The coupler according to the invention thus presents at least the following two advantages:

- connection by a press fit (therefore without soldering) to the printed-circuit board, affording a high-quality, low-cost electrical contact.
- easy and effective adaptation to suit a varying thickness of printed-circuit board because this coupler is made in several parts.

According to a preferred version of the invention, the rod-shaped contact piece is hollow and comprises a central part which can expand radially when forcibly inserted into the hole in the printed-circuit board.

The radial expansion of the hollow central part of this contact piece makes it possible to establish an excellent mechanical and electrical connection between this piece and the hole in the printed-circuit board.

Also as a preference, the rod-shaped contact piece, near one of its ends, has a shoulder which, upon mounting, presses against a shoulder made in the cavity of one of the contact members.

These two shoulders limit the extent to which the rod-shaped contact piece can be push-fitted into the cavity of one of the two contact members.

Also as a preference, the rod-shaped contact piece has, at its opposite end to the and which has the shoulder, a part with a narrowed diameter that can engage to a greater or lesser depth in the cavity of the corresponding contact member, according to the thickness of the printed-circuit board.

This rod-shaped contact piece thus allows the coupler according to the invention to adapt easily to suit printed-circuit boards of varying thickness.

Advantageously, the central part, which can expand radially, of the rod-shaped contact piece is externally connected to the part that has a narrowed diameter, by an essentially frustoconical surface.

This surface, which is essentially frustoconical, makes it easier for the rod-shaped contact piece to be forcibly push-fitted Into the hole in the printed-circuit board.

Other specific features and advantages of the invention will emerge more fully from the following description.

In the appended drawings which are given by way of non-limiting example:

Figure 2:
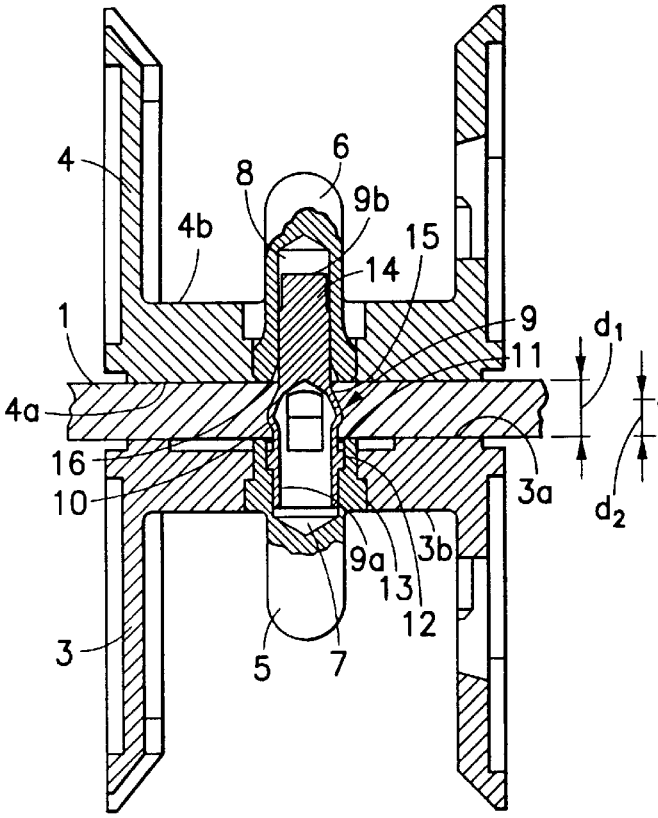
FIG. 2 is a view in axial section of a coupler according to the invention, mounted on a printed-circuit board.
Figure 3:
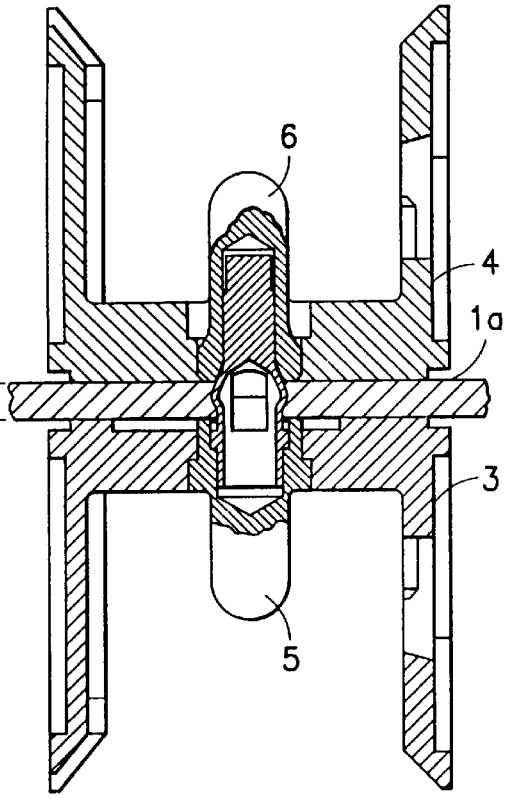

FIG. 3 in a view similar to FIG. 2, the coupler being mounted on a printed-circuit board which is thinner than the one in FIG. 2.

In the embodiment of the appended figures, the high-power connecting coupler for a printed-circuit board 1 (see FIGS. 2 and 3) is inserted into two housings 3, 4 made of electrically insulating material of connectors which are intended to be placed one on each side of the printed-circuit board 1, 1*a* and each bearing a contact member 5, 6.

In accordance with the invention, each contact member 5, 6 comprise an internal cavity 7, 8 open to that face 3*a*, 4*a* of the insulating housing 3, 4 that in intended to come to rest against the printed-circuit board 1, 1*a*.

The connecting coupler further comprises a rod-shaped contact piece 9. the opposite ends 9*a*, 9*b* of which can engage in the respective cavities 7, 8 of the two contact members 5, 6.

Futhermore, the central part 10 of this contact piece 9 is intended to be forcibly inserted into a hole 11, preferably metallized, in the printed-circuit board 1, 1*a*. Thus, by virtue of the contact piece 9, an electrical connection is made between a conducing track of the printed circuit and the two contact members 5, 6 borne by the two insulating bases 3, 4.

Figure 1:
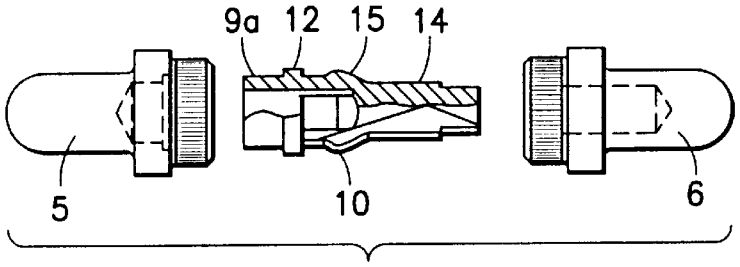
FIG. 1 is an exploded part-section view of the three contact pieces of a connecting coupler according to the invention.

As shown by FIGS. 1 to 3, the rod-shaped contact piece 9 is hollow and comprises a central part 10 which can expand radially when it is forcibly inserted into the hole 11 in the printed-circuit board 1, 1*a*.

Furthermore, the rod-shaped contact piece 9 comprises, near its end 9*a*, a shoulder 12 which, upon mounting, presses against a shoulder 13 made in the cavity 7 of the contact member 5.

What is more, the rod-shaped contact piece 9 has, at its opposite end to the end 9*a* that comprises the shoulder 12, a part 14 which has a narrowed diameter which can engage to a greater or lesser depth in the cavity 8 of the corresponding contact member 6, according to the thickness $d_2$ or $d_2$ of the printed-circuit board 1, 1*a*.

FIGS. 1 to 3 also show that the central part 10, which can expand radially, of the rod-shaped contact piece 9 is externally connected to the part that has a narrowed diameter by an essentially frustoconical surface 15.

Furthermore, the cavity 8 of the contact member intended to house the narrowed part 14 of the rod-shaped contact piece 9 opens onto the bearing face 4*a* of the corresponding insulating base 4 via a flared entry 16.

As shown in FIGS. 2, 3, the two contact members 5, 6 borne by the insulating housing 3, 4 each project from the opposite face 3*b*, 4*b* of the base to the one which presses on the printed-circuit board 1, 1*a*.

The way in which the connecting coupler just described is mounted on the printed-circuit board 1, 1*a* will now be explained.

The steps in mounting the coupler are as follows:

inserting the part 9 into the contact member 5;

insulating housing in the insulation 3 and insertion of the assembly on the board;

installation of the part 6 in the insulating housing 4 and positioning of the assembly on the part 14 of the part 9;

insertion of the assembly.

The friction created during this fitting together operation tends to radially expand the central part 10 of the piece 9 in the hole 11 in the printed-circuit board 1, 1*a*.

In the case of a relatively thick printed-circuit board (see FIG. 2), the narrowed part 14 of the piece 9 engages only partially in the cavity 8 of the contact member 6.

By contrast, in the case of a relatively thin printed-circuit board (see FIG. 3), the narrowed part 14 of the piece 9 fully engages in the cavity 8 of the contact member 6.

FIGS. 2 and 3 also show that the flared entry 16 to the cavity 8 in the contact member 6 makes it easier for the piece 9 to engage in this cavity.

Likewise, the frustoconical shape 15 which connects the narrowed part 14 of the piece 9 to its central part 10 makes it easier for this piece 9 to engage in the hole in the printed-circuit board 1, 1*a*.

Thus, whatever the thickness of the printed-circuit board, excellent electrical contact between the two contacts 5 and 6 is obtained.

Of course, the invention is not restricted to the embodiment which has been described, and numerous modifications may be loads thereto without departing from the scope of the invention.

I claim:

1. A connecting coupler for a printed-circuit board (1, 1*a*) connecting coupler being inserted into two housings (3, 4) made of electrically insulating material which are intended to be placed one on each side of the printed-circuit board (1, 1*a*), the coupler comprising:

two contact members, each housing bearing one of the contact members (5, 6), wherein each contact member (5, 6) comprises an internal cavity (7, 8) open to a face (3*a*, 4*a*) of the insulating housing (3, 4) that is intended to rest against the printed-circuit board (1, 1*a*), and wherein the coupler further comprises;

a contact piece (9) in the shape of a rod, the opposite ends (9*a*, 9*b*) of which can engage in the respective internal cavities (7, 8) of the two contact members (5, 6), while the central part (10) of this contact piece is intended to be forcibly inserted into a hole (11) in the printed-circuit board (1, 1*a*) to establish an electrical connection between a conducting track of the printed-circuit and the two contact members (5, 6) borne by the two insulating housings (3, 4), and wherein one of the opposite ends of the contact piece (9) is adapted to engage to a greater or lesser depth in the internal cavity of a corresponding one of the contact members depending upon the thickness of the printed-circuit board.

2. Coupler according to claim 1, characterized in that the rod-shaped contact piece (9) is hollow and comprises a central part (10) which can expand radially when forcibly inserted into the hole (11) in the printed-circuit board (1, 1*a*).

3. Coupler according to claim 1, characterized in that the rod-shaped contact piece (9), near one of its ends (9*a*), has a shoulder (12) which, upon mounting, presses against a shoulder (13) made in the cavity (7) of one (5) of the contact members.

4. Coupler according to claim 1, characterized in that the rod-shaped contact piece (9) has, at its opposite end to the end (9*a*) which has the shoulder (12), a part (14) with a narrowed diameter.

5. Coupler according to claim 4. characterized in that the central part (10), which can expand radially, of the rod-shaped contact piece (9) is externally connected to the part (14) that has a narrowed diameter, by an essentially frustoconical surface (15).

6. Coupler according to claim 4, characterized in that the cavity (8) of the contact member (6) intended to house the narrowed part (14) of the rod-shaped contact piece (9), opens onto the bearing face (4*a*) of the corresponding insulating housing (4) via a flared surface (16).

7. Coupler according to claim 1, characterized in that the two contact members (5, 6) borne by the insulating housings (3, 4) of the connectors each project from the opposite face (3*a*, 4*a*) of the printed-circuit board (1, 1*a*).

* * * * *